US012677903B2

(12) United States Patent
Bartys et al.

(10) Patent No.: US 12,677,903 B2
(45) Date of Patent: Jul. 14, 2026

(54) KNITTED COMPONENT WITH CUSHIONING STRUCTURE

(71) Applicant: NIKE, Inc., Beaverton, OR (US)

(72) Inventors: Samuel L. Bartys, London (GB); Bilan Dedonato, Portland, OR (US); Andreas I. Schoppel, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/672,599

(22) Filed: May 23, 2024

(65) Prior Publication Data

US 2024/0389705 A1 Nov. 28, 2024

Related U.S. Application Data

(60) Provisional application No. 63/468,961, filed on May 25, 2023.

(51) Int. Cl.
*A43B 1/04* (2022.01)
*A43B 23/02* (2006.01)

(52) U.S. Cl.
CPC ..... *A43B 1/04* (2013.01); *A43B 23/028* (2013.01); *D10B 2501/043* (2013.01)

(58) Field of Classification Search
CPC ..... A43B 1/04; A43B 23/028
See application file for complete search history.

(56) References Cited

U.S. PATENT DOCUMENTS 872,163 A * 11/1907 Williams ..... D04B 1/104 66/196
4,785,558 A * 11/1988 Shiomura ..... A43B 23/025 66/196
4,891,958 A * 1/1990 Cournoyer ..... D04B 1/104 66/196
11,197,518 B2 * 12/2021 Henrichot ..... A43B 23/0245
2014/0068968 A1 * 3/2014 Podhajny ..... D04B 15/56 36/50.1
2015/0059209 A1 * 3/2015 Dekovic ..... A43B 23/0275 36/84

(Continued)

FOREIGN PATENT DOCUMENTS

EP 3839116 A1 6/2021

OTHER PUBLICATIONS

International Search Report and Written Opinion received for PCT Patent Application No. PCT/US2024/030938, mailed on Aug. 13, 2024, 12 pages.

*Primary Examiner* — Megan E Lynch
(74) *Attorney, Agent, or Firm* — Shook, Hardy & Bacon L.L.P.

(57) ABSTRACT

Aspects herein are directed to a knitted component and articles of footwear that incorporate the same having cushioning structures, window openings, and/or tensile elements. In some aspects, the cushioning structures are positioned on an interior surface of an upper in order to protect a wearer's foot. The cushioning structures can be formed of single-jersey constructions, which cause the cushioning structures to curl, enhancing their cushioning properties. Window openings can be formed in the upper (e.g., using activatable yarns) in order to provide visual indications of the cushioning structures and/or serve as anchor points for tensile elements, which can provide structure to a lacing system.

15 Claims, 6 Drawing Sheets

(56) References Cited

U.S. PATENT DOCUMENTS

| | | | | |
|---|---|---|---|---|
| 2015/0216256 | A1* | 8/2015 | Podhajny | A43B 1/04 12/142 R |
| 2015/0289579 | A1* | 10/2015 | Meir | D04B 1/246 36/9 R |
| 2016/0090670 | A1* | 3/2016 | Meir | A43B 23/027 66/190 |
| 2017/0245582 | A1* | 8/2017 | Green | A43B 1/04 |
| 2019/0075889 | A1* | 3/2019 | Lang | A43B 23/0205 |
| 2019/0313728 | A1* | 10/2019 | Berrian | A43B 23/042 |
| 2019/0328075 | A1* | 10/2019 | Poulsen | A43B 23/0235 |
| 2020/0022457 | A1* | 1/2020 | Oordt | A43B 1/04 |
| 2020/0187595 | A1* | 6/2020 | Siegismund | D04B 1/22 |
| 2021/0120906 | A1* | 4/2021 | Donovan | A43C 1/003 |
| 2021/0186156 | A1* | 6/2021 | Pogl | D04B 1/102 |
| 2021/0219661 | A1* | 7/2021 | Line | A43B 23/0205 |
| 2022/0240624 | A1* | 8/2022 | Danby | D04B 1/18 |
| 2023/0200481 | A1* | 6/2023 | Suzuki | A43B 23/088 36/45 |

* cited by examiner

KNITTED COMPONENT WITH CUSHIONING STRUCTURE

CROSS-REFERENCE TO RELATED APPLICATION

This application entitled "Knitted Component With Cushioning Structure," claims the benefit of priority to U.S. Prov. App. No. 63/468,961, entitled "Knitted Component With Cushioning Structure," and filed May 25, 2023. The entirety of the aforementioned application is incorporated by reference in its entirety herein.

TECHNICAL FIELD

Aspects herein relate to knitted components with cushioning structures—e.g., for forming uppers of articles of footwear or articles of apparel—and tensioning systems for articles of footwear.

BACKGROUND

Various articles, including footwear, are formed of textiles, which are often formed by weaving or interlooping (e.g., knitting) one or more yarns. In particular, an upper for an article of footwear may be formed from a knitted textile. In some cases, an interior surface (e.g., a lateral or medial surface) of an upper can abrade a wearer's foot during wear, causing discomfort.

BRIEF DESCRIPTION OF THE DRAWINGS

Examples of aspects herein are described in detail below with reference to the attached drawing figures, wherein.

DETAILED DESCRIPTION

Figure 1:
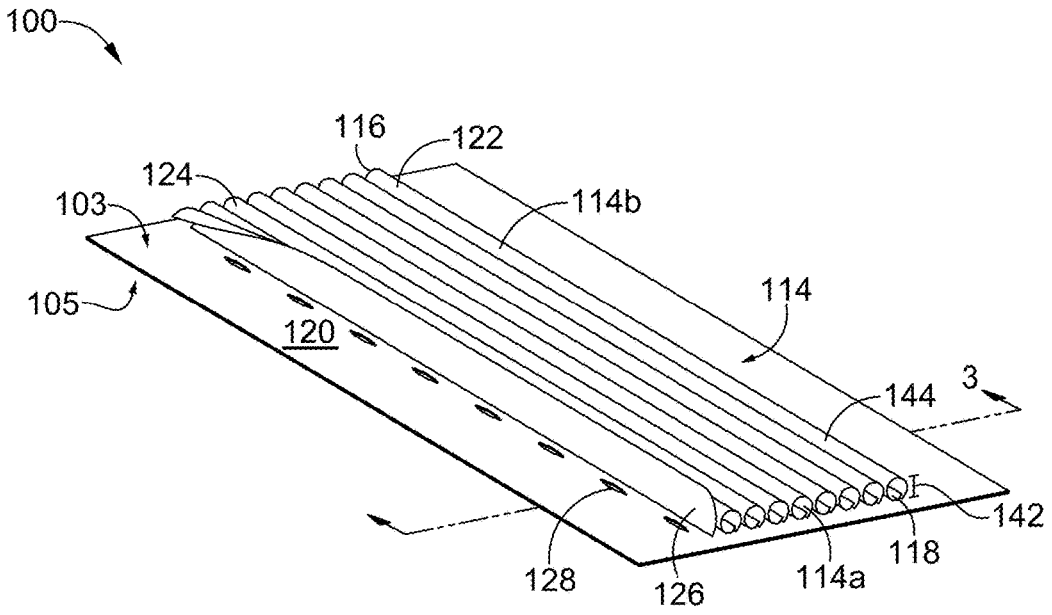
FIG. 1 illustrates a first side of a knitted component in accordance with aspects herein.

Various articles, including footwear or apparel, are formed of textiles, which are often formed by weaving or interlooping (e.g., knitting) one or more yarns. In particular, an upper for an article of footwear may be formed from a knitted textile. In some cases, an interior surface (e.g., a lateral or medial surface) of an upper can abrade a wearer's foot during wear, causing discomfort. Some articles of footwear include structures (e.g., insoles or padding) intended to protect the wearer's foot. However, such structures are typically added to footwear articles via post-processing steps that increase manufacturing time and complexity, and are often formed from materials that negatively impact the article's recyclability. Additionally, structures on the interior surface of an upper are not typically visible from the outside, thereby reducing the likelihood that a potential wearer will readily see the cushion and support afforded by the footwear. Similar issues may arise with articles of apparel.

At a high level, aspects herein are directed to knitted components, knitted uppers, and articles of footwear comprising one or more integrally-knit cushioning structures. The cushioning structure can comprise a yarn knitted in a single-jersey construction, which may cause the cushioning structure to curl and form a tubular shape, enhancing the cushioning structure's cushioning properties. The cushioning structure can be formed, at least in part, from a chenille yarn for added comfort. In aspects, a plurality of cushioning structures extend parallel to one another. The cushioning structure(s) can be knitted into an interior of a lateral and/or medial side of a knitted upper, for example.

Additional aspects of this disclosure relate to knitted components, knitted uppers, and articles of footwear comprising window openings. The window openings can be formed in a same region of the knitted component or knitted upper as the cushioning structure such that the cushioning structure is at least partially visible through the window openings, providing a viewer with a visual indication of the cushioning structure, for example. The window openings can also serve as guides or anchor points for tensioning elements. In embodiments, the tensioning elements weave through window openings and form loops superior to the window openings. The loops can serve as guides for laces of the article of footwear, for example. In one example, the window openings are integrally formed with a knitted component or upper by activating (e.g., heating) a releasable yarn, causing edges of a window region to separate from one another.

As used herein, the term "article of footwear" generally includes an upper and a sole structure. The upper is secured to the sole structure and forms a void within the article of footwear for comfortably and securely receiving a foot. As used herein, the term "upper" refers to a footwear component that extends over the instep and toe areas of the foot, along the medial and lateral sides of the foot, and around the heel area of the foot to form a void for receiving a wearer's foot. Illustrative, non-limiting examples of uppers may include uppers incorporated into a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. Further, in other aspects, the upper may also be incorporated into a non-athletic shoe, such as a dress shoe, a loafer, and a sandal. Accordingly, the concepts disclosed with respect to articles of footwear apply to a wide variety of footwear types.

The term "exterior" as used herein means a surface of the upper or article of footwear that faces the external environment. In some aspects, the outer surface may mean the outermost surface of the upper or article of footwear. The term "interior" as used herein means a surface of the upper or article of footwear that faces a void for receiving the wearer's foot. In some aspects, the interior surface may mean the innermost surface of the upper or article of footwear.

The term "knitted component" or "knitted upper" refers to a textile piece that is formed from at least one yarn that is manipulated (e.g., with a knitting machine) to form a plurality of intermeshed loops that define courses and wales. The term "course," as used herein, refers to a predominantly horizontal row of knit loops (in an upright textile, as knit) that are produced by adjacent needles during the same knitting cycle. The course may comprise one or more stitch types, such as a knit stitch, a held stitch, a float stitch, a tuck stitch, a transfer stitch, a rib stitch, and the like, as these terms are known in the art of knitting. The term "knit stitch," as used herein, refers to the basic stitch type where the yarn is cleared from the needle after pulling a loop of the yarn from the back to the front of the textile through a previous stitch and may be referred to herein as "knit loop." The term "wale," as used herein, is a predominantly vertical column of intermeshed or interlooped knit loops, generally produced by the same needle at successive (but not necessarily all) courses or knitting cycles. Knitted components described herein may include weft-knitted or warp-knitted components.

The term "integrally knit," as used herein, may mean a knit textile having a yarn from one or more knitted courses in one area being interlooped with one or more knitted courses of another area. The interlooping may be through a simple knit stitch, a tuck stitch, a held stitch, a float or miss stitch, and the like. In this way, areas that are integrally knit together have a seamless transition.

Additionally, there are various measurements provided herein. Unless indicated otherwise, all measurements provided herein are taken when the knitted component, upper and/or article of footwear is at standard ambient temperature and pressure (298.15 K and 100 kPa) and is in a resting (non-tensioned) state. Unless indicated otherwise, the term "about" or "substantially" with respect to a measurement means within ±10% of the indicated value.

FIG. 1 illustrates a knitted component 100. The knitted component 100 includes a first surface 120 forming a first side 103 of a main body portion 104 of the knitted component 100. In embodiments in which the knitted component 100 is incorporated into an article, the first surface 120 can correspond to an interior surface. The knitted component 100 includes cushioning structures 114 positioned on the first surface 120 such that the cushioning structures 114 are on the main body portion 104 of the knitted component 100. The cushioning structures 114 each extend away from the first surface 120 of the main body portion 104 of the knitted component 100 and are at least partially compressible or malleable. As such, each cushioning structure 114 may have a height 142 extending from the first surface 120 of the main body portion 104 to a protruding end 144 of the cushioning structure 114. The cushioning structures 114 may have the same height 142, or the height 142 may vary between different cushioning structures 114. For example, in some embodiments, the height 142 may gradually increase or decrease from one cushioning structure 114 to an adjacent cushioning structure 114. That is, a first cushioning structure may have a first height, a second cushioning structure may have a second height, and cushioning structures positioned between the first cushioning structure and the second cushioning structure may gradually vary (i.e., increase or decrease) in height from the first height to the second height. Additionally, in some aspects, each cushioning structure 114 may have a uniform height 142 or the height 142 may vary within a single cushioning structure 114. The height 142 of the cushioning structures 114 at least partially aids in providing cushion for an article incorporating the knitted component 110.

In some embodiments, the cushioning structures 114 are formed of a knitted construction. Further, the cushioning structures 114 may be integrally knit with the knitted component 100. In some aspects, each cushioning structure 114 comprises an elongated structure comprising one or more courses of yarn. In some embodiments, the cushioning structures 114 are at least partially formed from a chenille yarn. Chenille yarns are generally formed with short length yarns between two core yarns twisted together and result in textiles with a relatively large pile and soft hand-feel. As such, forming the cushioning structures 114 at least partially from a chenille yarn may create additional loft or cushion to protect the wearer's foot from abrasion or impact while enhancing the comfortability of the article (e.g., article of footwear) into which the knitted component 100 is incorporated.

The cushioning structures 114 can additionally (or alternatively) be at least partially formed from a yarn comprising recycled leather, which may be referred to herein as scrap leather yarn ("SLY"). In some aspects, the recycled leather yarn comprises a combination of leather scraps and polyethylene terephthalate (PET), which may be in the form of recycled PET. In one example, the recycled leather yarn is formed from about 50% leather scraps and about 50% PET (e.g., by weight). In other embodiments, the recycled leather yarn is formed from about 25% leather scraps and about 75% PET; about 35% leather scraps and about 65% PET; or about 70% leather scraps and about 30% PET. Other ratios of leather scraps and PET (or another material, including another recyclable material) are also contemplated. The leather scraps and the PET can be mixed together before carding and spinning into the recycled leather yarn. The leather scraps can imbue the recycled leather yarn with a soft hand-feel. Moreover, the recycled leather yarn is sustainable since it can be formed from recycled materials (i.e., the leather scraps and, in some aspects, the recycled PET). The recycled leather yarn's sustainability is further enhanced by its loft, which can allow portions of the knitted component 100, such as the cushioning structures 114, to be formed with significantly less material (e.g., per unit area or unit volume) as compared to a traditional yarn. Moreover, forming the cushioning structures 114 from a combination of the chenille yarn and the recycled leather yarn (e.g., at least one strand of the chenille yarn and at least one strand of the recycled leather yarn) can enhance any of the aforementioned benefits. For example, one or more of the cushioning structures 114 may be formed from one end of a chenille yarn and one end of a recycled leather yarn.

Each cushioning structure 114 may have a length extending from a first end 116 to a second end 118. In some embodiments, one or more of the cushioning structures 114 extend from the first end 116 to the second end 118 in a course-wise direction. Further, in some aspects, the cushioning structures 114 extend from the first end 116 to the second end 118 parallel to the course-wise direction of the main body portion 104. At least some of the cushioning structures 114 may extend parallel (or substantially parallel) to one another. Any adjacent cushioning structures 114 can contact one another at one or more points—e.g., along an entirety of a length of one or more cushioning structures. For example, at least some of the surface of a cushioning structure 114 that extends between the first end 116 and the second end 118 may abut part of a respective surface on an adjacent cushioning structure 114. The cushioning structures 114 can vary in length between the first end 116 and the second end 118—e.g., based on a length, width, or height of the knitted component 100 in an area or region in which a cushioning structure is positioned.

Figure 2:
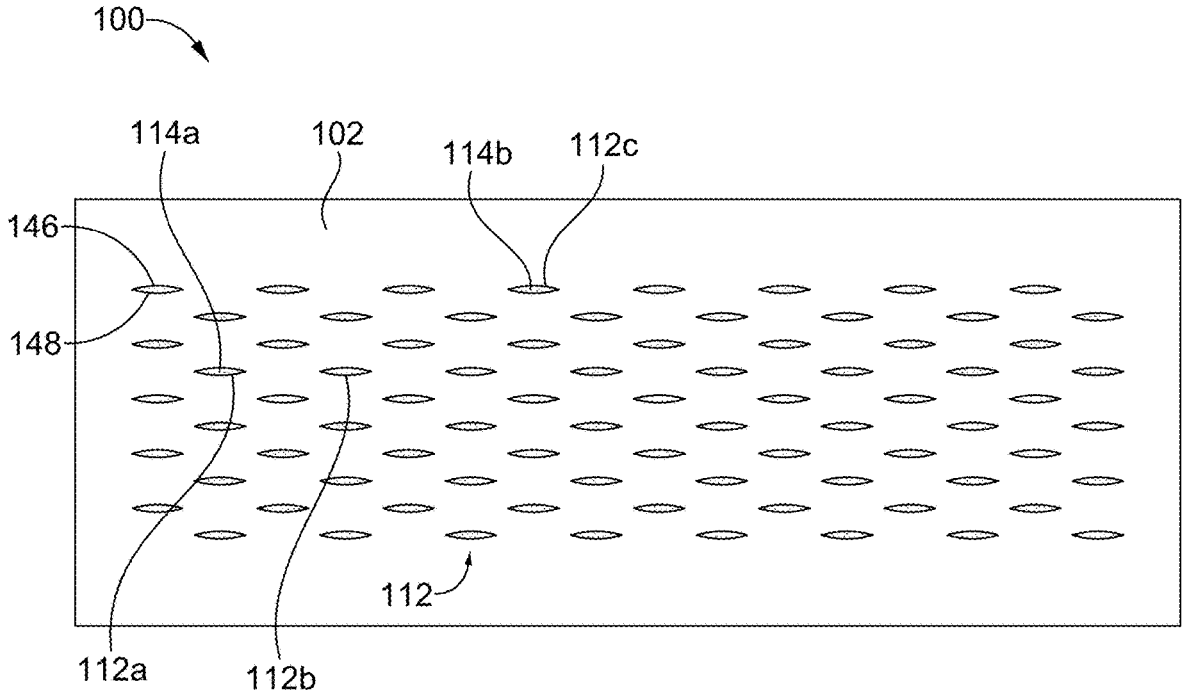
FIG. 2 illustrates a second side of a knitted component in accordance with aspects herein.

FIG. 2 depicts a second side 105 of the knitted component 100, showing the knitted component 100 comprising a second surface 102 of the main body portion 104 that is opposite the first surface 120 from FIG. 1. In embodiments in which the knitted component 100 is incorporated into an article, the first surface 102 can correspond to an exterior surface of the article.

In some embodiments, the knitted component 100 comprises one or more window openings 112. The window openings 112 extend through the first surface 102 and the second surface of the main body portion 104. At least some of the window openings 112 are positioned to provide a view of the cushioning structures 114 from the second side 105 of the knitted component 100. In other words, at least some of the window openings 112 are positioned to align with at least part of a cushioning structure 114 such that at least part of the cushioning structure 114 on the first side 103 of the knitted component 110 is visible through a window opening 112 when the knitted component 110 is being viewed from the second side 105. The window openings 112 may also aid in breathability, which may be particularly important when thicker yarns, such as chenille, form interior aspects of an article with the knitted component 100.

Any of the window openings 112 may be positioned to align (e.g., horizontally or vertically) with one another such that the window openings 112 may form a pattern of rows and/or columns within the knitted component 100. Further, this arrangement of the window openings 112 may be used to form a grouping of window openings 112 (e.g., a row of window openings 112 positioned at a same height) that expose a cushioning structure 114. Accordingly, if a cushioning structure 114 extends horizontally, for example, a first window opening 112*a* can reveal a first portion of the cushioning structure 114 and a second window opening 112*b* (e.g., that is positioned at a same height as the first window opening) can reveal a second portion of the same cushioning structure 114. In the same or other embodiments, different window openings 112 can reveal different cushioning structures 114. That is, a first cushioning structure 114*a* (seen in FIG. 1) can be visible through a first window opening 112*a*, and a second (e.g., different) cushioning structure 114*b* (seen in FIG. 1) can be visible through a different window opening 112*c*.

The window openings 112 may be integrally formed within the knit structure of the knitted component 110 and through at least one post-processing step. For example, in some embodiments, the window openings 112 are formed through knitting loops of a fusible yarn (which may also be referred to herein as an activatable yarn) and heating the fusible yarn to melt such yarn for creation of an opening. Further details of this process are described further with respect to FIGS. 5A-6. In other embodiments, the window openings 112 are integrally knit openings formed without post-processing, such as by omitting stitches in the knitted component 100. In other embodiments, the window openings 112 may be stamped or otherwise cut into the knitted component 100 after knitting or other post-processing steps.

Each window opening 112 is defined between at least a first edge 146 of the main body portion 104 and a second edge 148 of the main body portion 104. In some aspects, at least one of the first edge 146 and the second edge 148 includes a fusible material. For example, at least one of the first edge 146 and the second edge 148 may be formed by one or more courses of a yarn that includes a fusible material and, when the fusible yarn is heated and melting, the fusible material may help to finish the respective edge, thereby preventing fraying at the window opening 112. In some aspects, both the first edge 146 and the second edge 148 may include fusible material.

One or more of the cushioning structures 114 may be positioned on the knitted component 100 such that one or more of the window openings 112 is/are obscured from view when the knitted component 100 is viewed from the first side 103. For example, in FIG. 1, a cushioning structure 126 is shown in a partially uncurled state such that a window opening 128 is visible; when the cushioning structure 126 is in a curled state (e.g., as the cushioning structures 122 and 124 are depicted), the window opening 128 will be obscured from view by the cushioning structure 126 when viewing the first side 103 of the knitted component 100. In the curled state, the cushioning structures 122 and 124 gradually curves as they extend upward from the first surface 120 and then gradually curve and they extend down back toward the first surface 120. Each of the cushioning structures 122 and 124 may form a tubular structure. The curvature of the cushioning structures 122 and 124, and the resulting tubular structure formed therefrom, enables the cushioning structures 122 and 124 to efficiently distribute forces applied to their surfaces, mitigating impact and pressure points, which may enhance cushioning.

Figure 3:
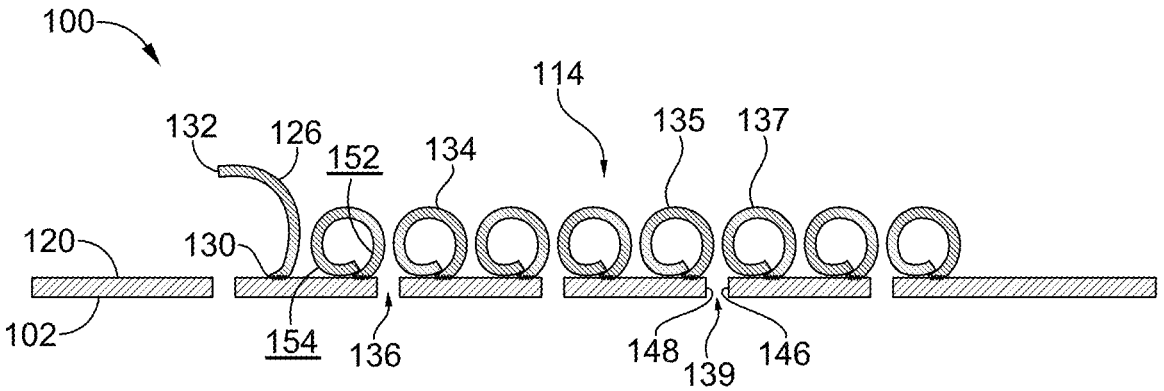
FIG. 3 illustrates a cross-sectional view of a knitted component in accordance with aspects herein.

Turning now to FIG. 3, FIG. 3 illustrates a cross-sectional view of the knitted component 100, including the first surface 120, the second surface 102, and the cushioning structures 114 (including the uncurled cushioning structure 126). Each of the cushioning structures 114 comprises a first edge 130 secured to the first surface 120 of the main body portion 104. First edges 130 of the cushioning structures can be secured to the first surface 120 by any suitable means, such as knitting, stitching, welding, bonding, or adhesive. In exemplary aspects, the first edge 130 of the cushioning structure 114 is joined to the first surface 120 by integrally knitting the cushioning structure 114 with the main body portion 104. Integrally knitting edges of cushioning structures with the first surface 120 may improve the recyclability of the resulting knitting component 100—e.g., by reducing or eliminating the need for adhesives or other contaminants while reducing manufacturing time. Further, each of the cushioning structures 114 comprises a second edge 132. In aspects, the second edge 132 is unsecured to the first surface 120 of the main body portion 104. Further, the second edge 132 may be unsecured to any portion of the knitted component 100. Alternatively, the second edge 132 may be secured to the first surface 120 of the main body portion 104 in any of the manners disclosed for the first edge 130.

In aspects, the cushioning structures 114 each comprise a strip or flap formed by one or more courses of yarn. Further, the cushioning structures 114 may comprise or are formed of a single-jersey construction—e.g., are formed on one needle bed of a knitting machine. For example, each cushioning structure 114 may include a single-jersey knit portion extending between the first edge 130 and the second edge 132 that is opposite the first edge 130. As such, the cushioning structures 114 may, in such aspects, each curl into shapes that are convex when viewed from the side associated with the first surface 120. The curl of the material forming the cushioning structures 114 may also form tubular shapes. As a result, the second edge 132 may contact the first surface 120 (as shown in FIG. 3 with respect to the cushioning structure 134, for example). In some aspects, at least some of the cushioning structures 114 curl such that the second edge 132 rests on an inner surface 152 of the tubular cushioning structure 114 while an opposite outer surface 154 of the cushioning structure 114 contacts the first surface 120 of the main body portion 104. However, the tubular shapes formed by the cushioning structures 114 are not necessarily always closed tubes. For example, in some embodiments, a cushioning structure 114 has a relatively smaller degree of curvature (i.e., curls to a lesser extent) such that the second edge 132 of the cushioning structure contacts the first surface 120 of the main body portion 104 but is spaced apart from the second edge 130 of the cushioning structure 114. In another aspect, a cushioning structure 114 may have an even smaller degree of curvature such that the second edge 132 does not contact either the first surface 120 of the main body portion or the inner surface 152 of the cushioning structure 114 (e.g., the second edge 132 may be spaced apart from the second surface 120).

Further, a curled cushioning structure (e.g., 134) may be positioned adjacent to one or more window openings (e.g., 136) such that the window openings are concealed by the cushioning structure from a perspective facing the second surface 120 and/or the cushioning structure is visible through the window opening from a perspective facing the first surface 102. In some aspects, at least some cushioning structures are positioned relative to window openings such that portions of two adjacent cushioning structures (e.g., cushioning structures 135 and 137) are visible through a single window opening (e.g., window opening 139). In some embodiments, the adjacent cushioning structures 135 and 137 may have a gap between them, which may be visible through the window opening 139. In other examples, outer surfaces of adjacent cushioning structures 135 and 137 abut one another such that window opening 139 is fully covered by the cushioning structures 135 and 137.

Figure 4:
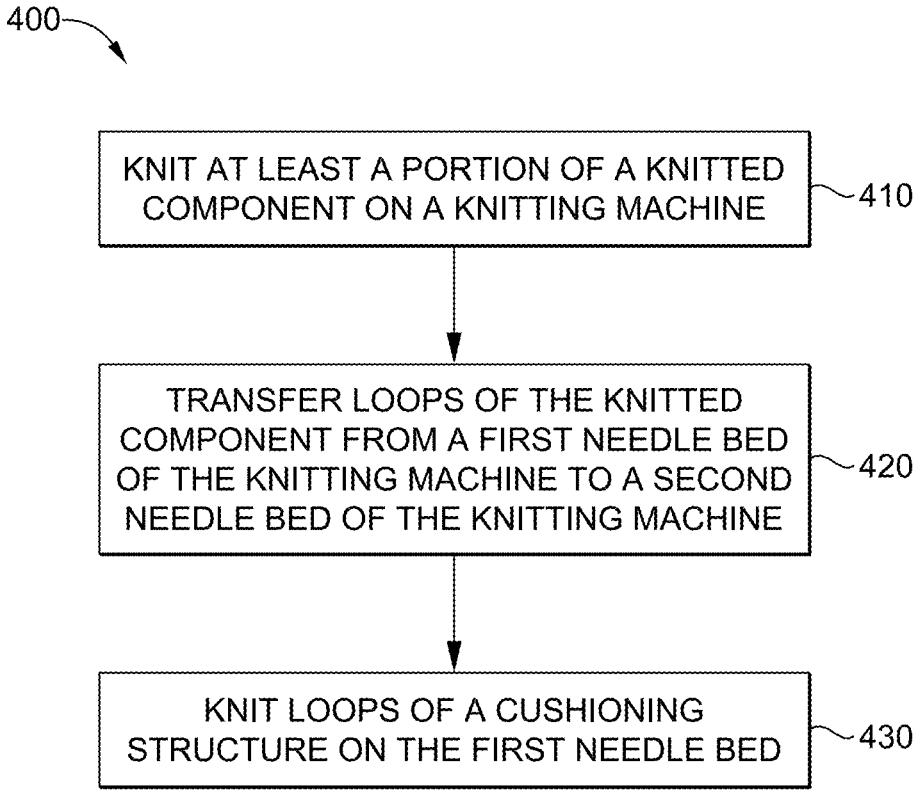
FIG. 4 illustrates a method of forming a cushioning structure in accordance with aspects herein.

Turning now to FIG. 4, a method 400 of forming a cushioning structure, such as the cushioning structure 114 from FIGS. 1-3, is provided. The steps provided in the method 400 are merely illustrative, and the method 400 may include additional steps that are not illustrated.

At step 410, at least part of a main body portion of a knitted component (e.g., the main body portion 104 of FIGS. 1-3) is knitted on a knitting machine. Step 410 may be performed on an automated knitting machine and, as such, may be performed and/or controlled using a control unit having a processor or computer communicatively coupled with or integrated into the knitting machine. In example aspects, the knitting machine used to knit the knitted component is a V-bed flat knitting machine having two needle beds—a front needle bed and a back needle bed—that are angled relative to each other to form a V-bed. The front and back needle beds may each include a plurality of individual needles extending across a common plane. A carriage may move feeder(s) along the front and back needle beds to supply yarns to needles. Although a flat V-bed knitting machine is described herein, it should be understood that this is one example and that other knitting machines may be used to form the knitted component or a portion thereof.

Further, step 410 may include knitting the main body portion of the knitted component on two needle beds of the knitting machine. In some examples, step 410 includes knitting the first portion to have a double-jersey knit construction. The main body portion of the knitted component can have any of the properties of the knitted component 100 previously described in regard to any of FIGS. 1-3. For example, the knitted component can be an article or component thereof, such as an upper for an article of footwear or an article of apparel.

At step 420, at least some of the loops of the main body portion knitted component are transferred from a first needle bed of the knitting machine to a second needle bed of the knitting machine. In this way, after step 420, loops forming at least a section of the main body portion are all on the second needle bed so that there is a section of needles on the first needle bed that are free. In aspects, the loops are transferred from a front bed of a V-bed knitting machine to a back bed of the V-bed knitting machine. In other aspects, the loops are transferred from the back bed to the front bed.

At step 430, loops of a cushioning structure are knitted on the first needle bed (e.g., the front needle bed of the V-bed knitting machine). These loops are formed at step 430 on needles that were freed after transferring loops of the main body portion of the knitted component at step 420. The loops of the cushioning structure can be knitted such that the cushioning structure comprises any of the properties described in regard to the cushioning structures 114 of any of FIGS. 1-3. The cushioning structure can be knitted using a different yarn than any of the yarn(s) used to form the main body portion of the knitted component. For example, the cushioning structure can be formed from at least one strand of a chenille yarn, at least one strand of a recycled leather yarn, or both. The cushioning structure is formed on a single bed of the knitting machine. Further, the cushioning structure may have a single-jersey knit such that the cushioning structure comprises a curling characteristic capable of forming a tubular shape.

The step 430 can further comprise knitting a plurality of cushioning structures-which can comprise any of the properties of the cushioning structure previously described-integrally with the knitted component. The cushioning structures can be positioned such that they extend parallel (or substantially parallel) to one another and/or contact one another.

After the cushioning structure is formed at step 430, the method 400 may include casting off loops forming the tubular structure, thereby freeing up needles on a first needle bed and continuing to knit remaining portions of the main body portion. Continuing to kit the main body portion may be similar to step 410 such that both needle beds may be used. Further, before a remaining portion of the main body portion is knit, loops previously transferred from the first needle bed to the second needle bed at step 420 may be transferred back to the first needle bed.

In some aspects, the method 400 may further include one or more steps of creating window openings extending through the main body portion, as disclosed further herein. Additionally, aspects of method 400 may include steps for forming the knitted component into an article, such as an article of footwear, which may include forming the knitted component into an upper and securing the upper to a sole structure, as further described herein.

Figure 5B:
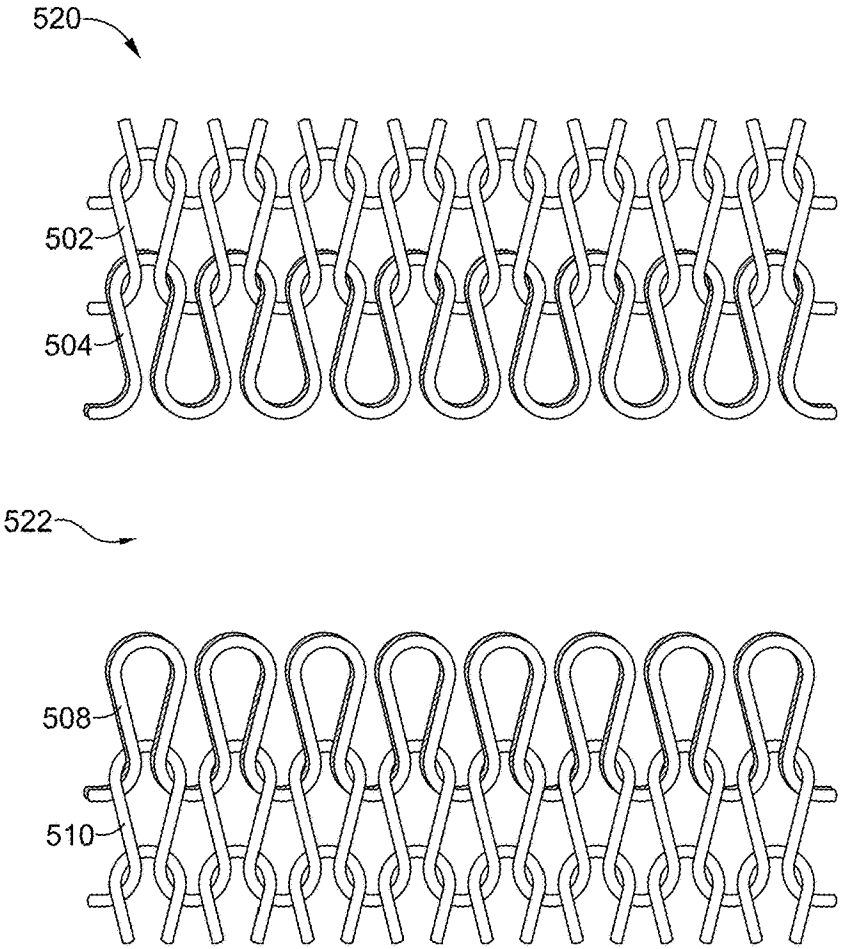
FIG. 5B illustrates the schematic knitted component of FIG. 5A with a window opening in accordance with aspects herein.
Figure 5A:
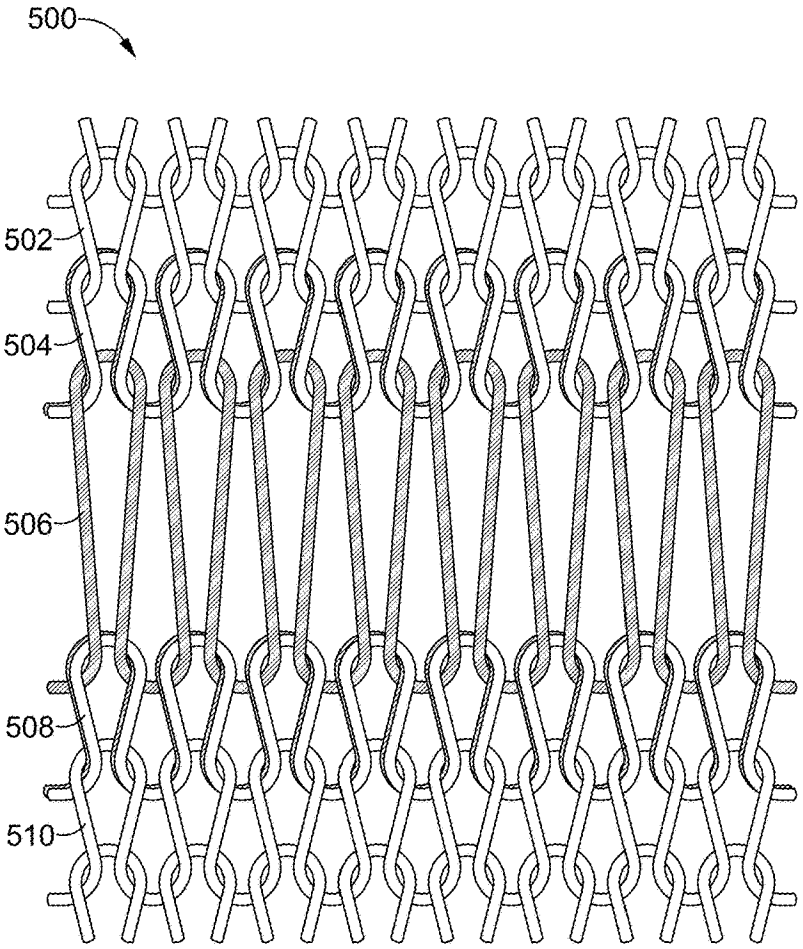
FIG. 5A illustrates a schematic knitted component with a window region in accordance with aspects herein.

Turning now to FIGS. 5A-5B, illustrations of a window region 500 and a window opening 520 are provided. At a high level, the window region 500 represents the window opening 520 prior to activation of the course of the activatable yarn 506. Further, the window opening 520 represents one embodiment of any of the window openings described herein, including window openings previously described in regard to FIGS. 1-3 (e.g., the window openings 112, 128, or 136).

In aspects, the window region 500, prior to activation, comprises a first course 502, a second course 504, a third course 506, a fourth course 508, and a fifth course 510. The first course 502 comprises a first yarn. The first yarn may be a type of yarn with which a main body portion of a knitted component (e.g., the main body portion 104 of the knitted component 100) is at least partially formed. In one example, the first yarn forming the first course 502 is a polyester yarn. The second course 504 directly interloops with the first course 502 and, in some aspects, with the third course 506. The second course 504 is formed at least partially with a second yarn that is capable of melting when heat is applied (e.g., is fusible), as further described herein. In some aspects, the second course 504 is formed with the first yarn and a second yarn that is activatable and plated with the first yarn. As used herein, an activatable is defined as having a physical change in response to a stimuli. For example, a yarn that softens or melts in response to heat would be considered an activatable yarn, such as a fusible yarn; however, yarns that are not fusible, yet have a physical change in response to a stimuli are also considered activatable yarns.

The second yarn comprises a material that melts, dissolves, shrinks, degrades, disintegrates, or otherwise changes physical properties in response to a process, exposure, treatment, and/or stimulus (e.g., heat). Any portion of the second yarn may have one or more thermoplastic polymers or other materials (collectively "the thermoplastic material"), and in some embodiments, the entirety or substantially the entirety of the second yarn may be formed of the thermoplastic material. In one non-limiting example, the second yarn may be a fusible yarn comprised of a polyester substrate with poly block amide resin, have a linear mass density of about 150 denier, a tenacity of about 2.5 cN/dtex, an elongation percentage of about 80%, a twist per meter (TPM) of around 300Z, and/or a melting temperature within the range of 55-65° C. based on atmospheric pressure at sea level. One suitable yarn is "Grilon® KE60," available commercially by EMS-Chemie AG of Switzerland.

Illustrative, non-limiting examples of thermoplastic material(s) that may comprise the second yarn include polyurethanes, polyamides, polyolefins, nylons, and resins. Thermoplastic polymers at least partially melt when heated to a certain temperature and return to a solid state when cooled below a certain temperature. More particularly, a thermoplastic polymer transitions from a solid state to a softened or liquid state when subjected to temperatures at or above its melting point, and then the thermoplastic polymer transitions from the softened or liquid state to a solid state when sufficiently cooled below its melting point. Furthermore, when heated to a certain temperature (approaching the melting temperature and beyond), a yarn made from thermoplastic material may significantly dissolve or shrink in physical size to create a void where the yarn previously existed. As such, thermoplastic materials may be melted, molded, cooled, hardened, dissolved, and/or caused to shrink through various heating and/or cooling cycles.

Plating the first yarn with the second yarn in the second course 504 can provide multiple benefits. For example, following exposure of the knitted component to a stimulus (e.g., heat) and formation of an opening 522 (shown in FIG. 5B), the second course 504 can form an edge of the opening 522 (e.g., first or second edges 146 and 148 in FIGS. 2 and 3). The second yarn in the second course 504 can melt during the activation (e.g., heating) process, thereby at least partially fusing to the first yarn in the second course 504. Fusing material from the second yarn to the first yarn in the second course 504 strengthens the edge of the opening 522 that corresponds to the second course 504, which limits unraveling or fraying.

In aspects, the third course 506 comprises the second yarn. In some aspects, the third course 506 does not comprise any yarns other than an activatable or fusible yarn, such as the second yarn. The third course 506 may be directly interlooped with the second course 504 and/or the fourth course 508. When the window region 500 is exposed to a stimulus (e.g., heat), the second yarn in the third course 506 melts, creating a void (e.g., the window opening 522) between the second course 504 and the fourth course 508, for example.

In embodiments, the fourth course 508 may be directly interlooped with the third course 506 and the fifth course 510. The fourth course 508 can comprise the first yarn (or a different yarn with a melting point greater than the second yarn), which can be plated with the second yarn. In some examples, the fourth course 508 has the same yarns as the second course 504. Because the fourth course 508 forms an edge of the opening 522 following activation, plating the first yarn with the second yarn in the fourth course 508 may impart the knitted component with the same benefits previously described in reference to the second course 504 (e.g., strengthening the edge and preventing unraveling or fraying). The fifth course 510 may be interlooped with the fourth course 508. The fifth course may comprise the first yarn.

Additionally, in some aspects, the fourth course 508 (and, in some aspects, the fifth course 510) is formed of a single-jersey construction. In these aspects, following melting of the third course 506, the fourth course 508 and/or fifth course 510 may curl away from the second course 504 (i.e., downward in the example shown in FIG. 5B) as a result of the single-jersey knit structure. Imparting the fourth course 508 and/or the fifth course 510 with a curling characteristic may further define, enlarge, and/or provide stability to the opening 522. In some aspects, the second course 504 (and, in some aspects, the first course 502) is also formed of a single-jersey construction so that it may curl away from the fourth course 508 after the third course 506 melts. Other courses formed before the fifth course 510 and after the first course 502 may have a double-jersey construction.

It should be understood that the window region 500 may have variations in the number of courses beyond what is illustrated in FIGS. 5A and 5B. For example, there may be two or more adjacent courses similar to the second course 504 formed of the first yarn and the second yarn, and there may similarly be two or more adjacent courses similar to the fourth course 504 formed of the first yarn and the second yarn. Additionally, there may be two or more adjacent courses similar to the third course 506 with a section of adjacent loops formed exclusively of the second yarn that will be melted to form the window opening 522.

Figure 6:
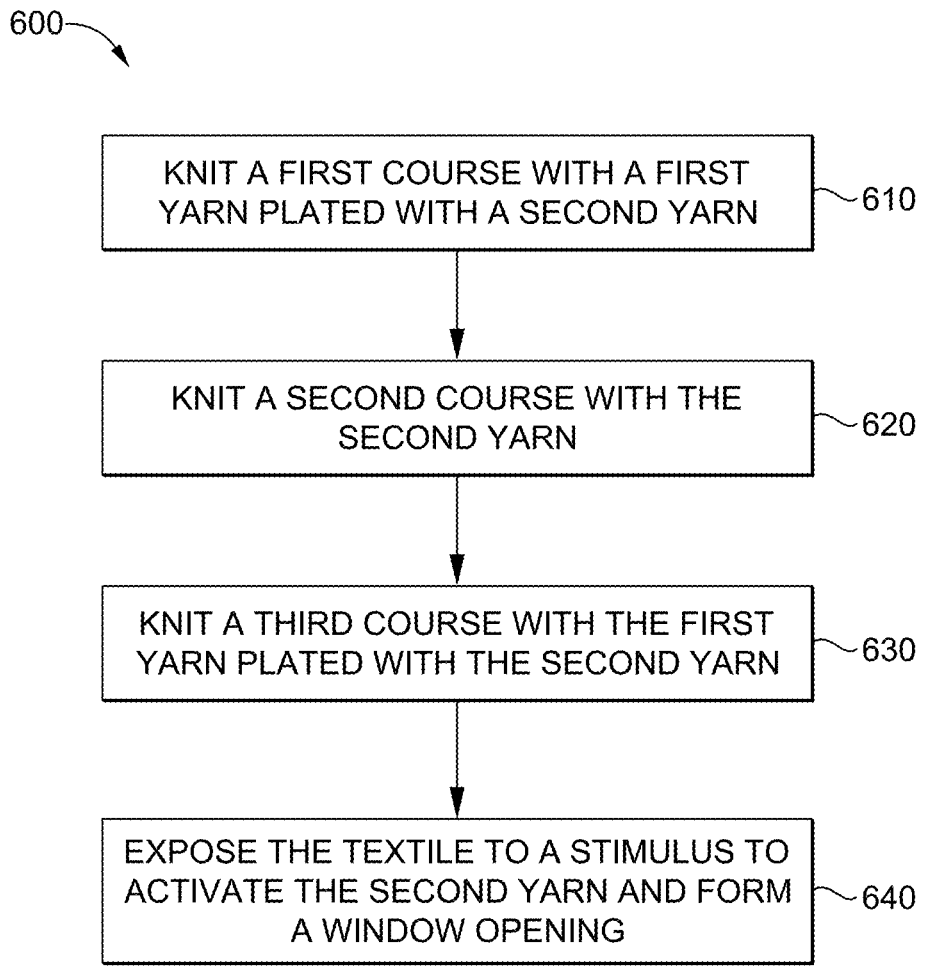
FIG. 6 illustrates a method of forming a window opening in a knitted component in accordance with aspects herein.

Turning now to FIG. 6, a method 600 of forming a window opening, such as the window opening 520, in a textile is provided. The steps provided in the method 600 are merely illustrative, and the method 600 may include additional steps that are not illustrated. The method 600 may be used to form the window region 500 and window opening 522 of FIGS. 5A and 5B, as well as any variations disclosed.

At step 610, a first course is knitted with a first yarn—e.g., the first yarn previously described in reference to FIGS. 5A-5B. The first course may be plated with a second yarn—e.g., the second yarn similar to the second course 504 previously described in reference to FIGS. 5A-5B. For example, the second yarn is an activatable yarn and/or comprises a lower melting temperature than the first yarn.

At step 620, a second course is knitted with the second yarn. At least a portion of the second course is knitted exclusively with the second yarn similar to the third course 506 described in reference to FIG. 5A. The second course can be interlooped with the first course.

At step 630, a third course is knitted with the first yarn plated with the second yarn, similar to the fourth course 508 described in reference to FIGS. 5A-5B. The third course may be interlooped with the second course. The third course may be formed of a single-jersey construction—e.g., on the first needle bed while loops of the second course are positioned on the second needle bed. In some aspects, at least the second course is formed on two needle beds of a knitting machine, and loops of the second course are transferred from the first needle bed to the second needle bed prior to step 630 to transition to a single-jersey construction.

At step 640, the textile is exposed to a stimulus to activate the second yarn and form a window opening similar to the window opening 522 of FIG. 5B. The stimulus can comprise heat or an aqueous solution, for example. As the second yarn melts and/or dissipates, a window opening is formed between the first course and the third course (e.g., in a portion of the textile in which the second course was previously present). Any remaining portions of the second yarn that do not dissipate may be removed from the window opening once the melted portions are re-hardened following a cooling process and broken away from the opening through physical agitation (e.g., stretching of the knitting component). Moreover, the second yarn can at least partially fuse to the first yarn (e.g., in the first and third courses), strengthening the edges of the window opening. In aspects in which the third course is knitted in a single-jersey construction, the third course may curl, further defining the window opening.

Figure 7:
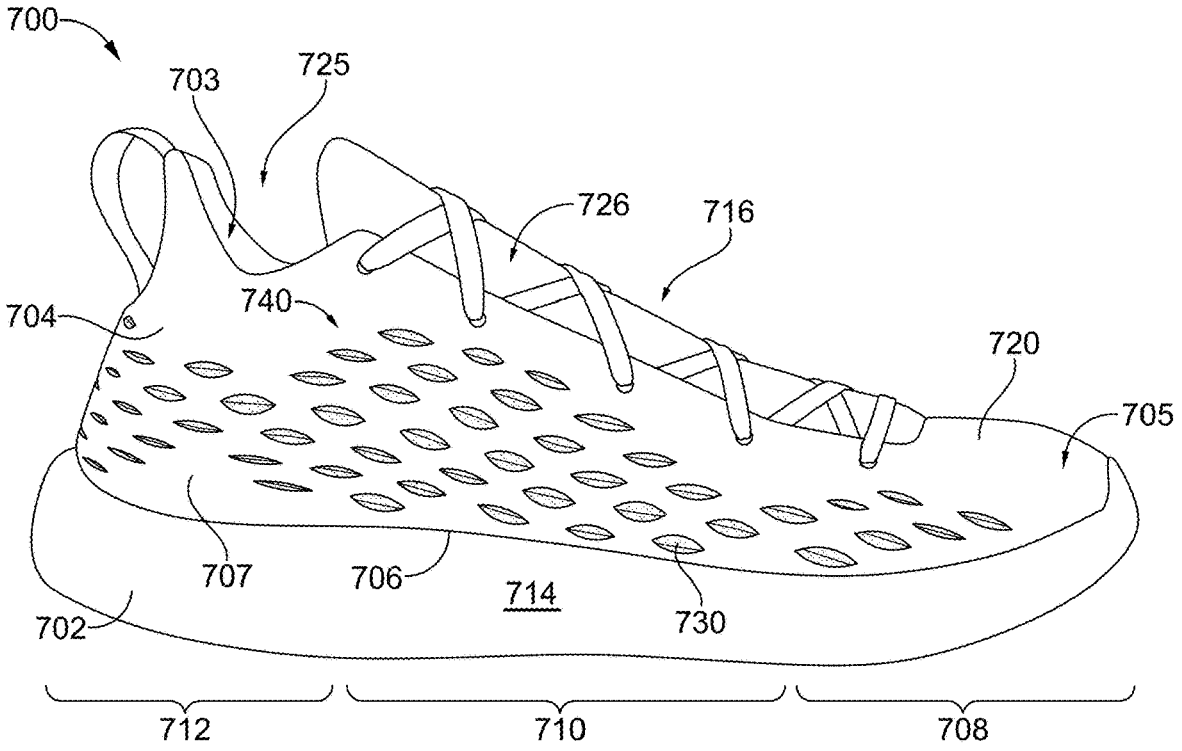
FIG. 7 illustrates an exterior view of an article of footwear in accordance with aspects herein.

Turning now to FIG. 7, a lateral perspective view of an article of footwear 700 is provided. The article of footwear 700 comprises a sole structure 702 and an upper 704. The upper 704 is coupled to and extends from the sole structure 702 and forms a foot-receiving void (which also may be referred to as a foot-receiving cavity) between the sole structure 702 and the upper 704. The area of the article of footwear 700 where the sole structure 702 meets or joins the upper 704 is referred to as the biteline 706. The upper 704 may be joined to the sole structure 702 in a fixed manner using any suitable technique, such as through the use of an adhesive, by sewing, etc. It is contemplated that the upper 704 may extend partially or completely around the foot of a wearer, may extend under the foot of a wearer, and/or may be integral with a sole structure, including but not limited to the sole structure 702. A sockliner, which may be referred to as a strobel, may or may not be used. The sockliner can comprise various materials including textile, leather, foam, and/or other types of materials.

The article of footwear 700 (and/or its components) can be divided into one or more regions (which can also be referred to as "areas" or "portions"). For example, in an anterior-to-posterior direction, the article of footwear 700 (and/or its components) can be divided into (and/or include) a forefoot region 708, a midfoot region 710, and a heel region 712. The forefoot region 708 of the article of footwear 700 can correspond to anterior portions of a foot, including toes and joints connecting metatarsal bones with phalanx bones of the foot. The midfoot region 710 of the article of footwear 700 can correspond with an arch area of the foot. The heel region 712 of the article of footwear 700 can correspond with posterior portions of the foot, including a calcaneus bone. In a medial-to-lateral direction, the article of footwear 700 (and/or its components) can be divided into a lateral side 714 and a medial side 716, both of which extend through the forefoot region 708, the midfoot region 710, and the heel region 712. More particularly, the lateral side 714 corresponds with an outside area of the foot (i.e., the side that faces away from the other foot) when the article of footwear 700 is worn, while the medial side 716 corresponds with an inside area of the foot (i.e., the side that faces towards the other foot) when the article of footwear 700 is worn. These regions 708, 710, and 712 and sides 714 and 716 are not intended to demarcate precise areas of the article of footwear 700 but, rather, are intended to represent general areas of the article of footwear 100 to aid in understanding the various descriptions provided herein.

The sole structure 702 generally extends between the foot and the ground when the article of footwear 700 is worn. The sole structure 702 may include multiple components, such as an outsole, a midsole, and an insole or sockliner. Various materials may be used to form the sole structure 702, such as rubber, ethylene vinyl acetate (EVA), thermoplastic polyurethane (TPU), thermoplastic elastomer (e.g., polyether block amide), and the like. The sole structure 702 may also include various other elements, such as a heel counter and a toe cap. The sole structure 702 may include various other features to attenuate forces, enhance stability, and/or provide traction, such as treads, as understood by one skilled in the art.

The upper 704 defines a void within the article of footwear 700 for receiving and securing a foot relative to the sole structure 702. Access to the foot-receiving void is provided by an ankle opening 725 located in at least the heel region 712. The upper 704 includes a throat region 726 disposed in the midfoot region 710 between the ankle opening 725 and the forefoot region 708. The throat region 726 may be configured to cover a top side of the wearer's foot and, therefore, form part of a top side (or overfoot region) of the upper 704 between the lateral side 714 and the medial side 716.

The article of footwear 700 depicted in the figures is intended to be used with a right foot; however, it should be understood that the following discussion may also apply to a mirror image of the article of footwear 700 that is intended for use with a left foot. Although an article of footwear is shown, it should be understood that other articles of wear are also contemplated by the present disclosure, including but not limited to apparel (e.g., shirts, jerseys, pants, shorts, gloves, glasses, socks, hats, caps, jackets, undergarments, or other apparel) and containers (e.g., backpacks, bags, or other containers). As such, various aspects disclosed herein may be incorporated into such other articles.

In example aspects, at least a portion of the upper 704 may be formed from at least one knitted component 720. The knitted component 720 forming the upper 704 may be an example embodiment of the knitted component 100 and, therefore, the knitted component 720 may be formed by any process or may comprise any property previously described in reference to the knitted component 100 unless indicated otherwise. In some aspects, the entire or substantially the entire upper 704 is formed of the knitted component.

The knitted component 720 may incorporate various types of yarn that impart different properties to separate areas of the upper 704. That is, one area of the knitted component 720 may be formed from a first type of yarn that imparts a first set of properties, and another area of the knitted component 720 may be formed from a second type of yarn that imparts a second set of properties. In this way, properties may vary throughout the upper 704 by selecting specific yarns for different areas of the knitted component 720. The properties that a particular type of yarn will impart to an area of the knitted component 720 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability.

In addition to materials, other aspects of the yarns selected for the knitted component 720 may affect the properties of the upper 704. For example, a yarn forming the knitted component 720 may be a monofilament yarn or a multifilament yarn. As such, unless otherwise specified, the term "yarn," as used herein, does not require multiple filaments or fibers. The yarn may also include separate filaments that are each formed of different materials. In addition, the yarn may include filaments that are each formed of two or more different materials, such as a bicomponent yarn with filament(s) having a sheath-core configuration or two halves formed of different materials. Different degrees of twist and crimping, as well as different deniers, may also affect the properties of the upper 704. Accordingly, both the materials forming the yarn and other aspects of the yarn may be selected to impart a variety of properties to separate areas of the upper 704. Additional properties of yarn(s) used in various aspects of this disclosure are described in further detail below.

The knitted component 720 may be formed as a single integral one-piece element during a knitting process, such as weft knitting or any other suitable knitting process. Additional elements, such as an underfoot portion and/or a heel element may be integrally formed with the upper 704 as a one-piece unitary structure. Alternatively, one or more such additional elements may be formed separately from the upper 704 and then later attached, secured, or otherwise assembled as necessary. Forming the upper 704 with the knitted component 720 may provide the upper 704 with advantageous characteristics including, but not limited to, a particular degree of elasticity, breathability, bendability, strength, moisture absorption, weight, abrasion resistance, and/or a combination thereof. Further, forming the upper 704 from an integrally knit knitted component 720 may form various features and structures of the upper 704 without the need for significant additional manufacturing steps or processes, thereby increasing production efficiency.

Exemplary embodiments of the knitted component 720 for the upper 704 include one or more cushioning structures (e.g., 730) extending on a first side 703 from a main body portion 707. In some aspects, the main body portion 707 of the knitted component 720 generally includes a continuous knit structure extending from within the forefoot region 708 through a midfoot region 710 and to a heel region 712. Example aspects of the cushioning structures 730 on the upper 704 are further described with respect to the cushioning structures of the knitted component 100 of FIGS. 1-3. The cushioning structures 730 may be positioned at least partially in the midfoot region 710 of the upper 704 on at least one of the medial side 716 of the upper 704 and the lateral side 714 of the upper 704. In exemplary embodiments, the first side 703 of the knitted component 720 corresponds to an interior side or surface of the upper 704 such that the cushioning structures 730 extend interiorly into the foot-receiving void of the upper 704. In such embodiments, the cushioning structures 730 can, for example, cushion the wearer's foot and/or protect the foot from abrasion, enhancing comfort. The cushioning structures 730 may also be located in and/or extend into other portions of the article of footwear 700, such as the forefoot region 708 and the heel region 712.

Figure 8:
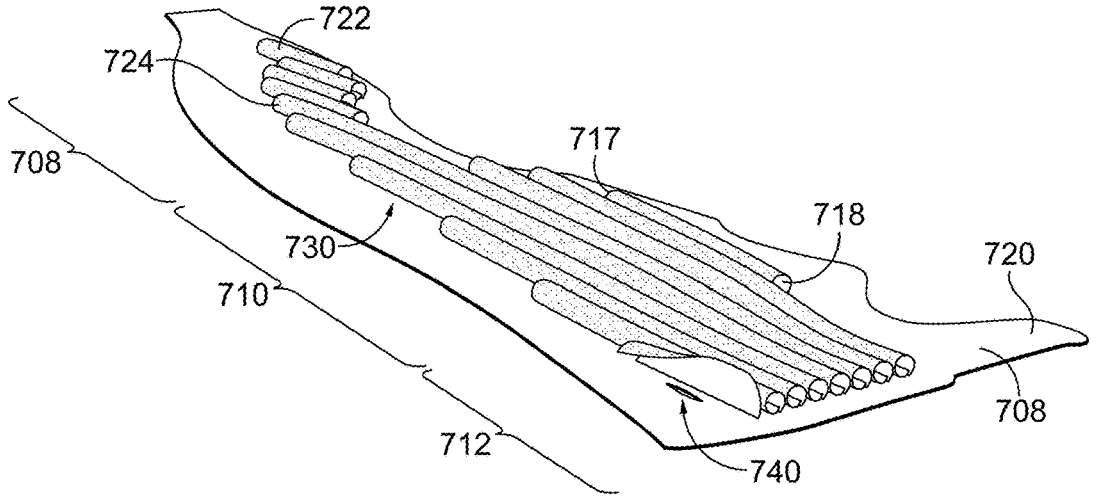
FIG. 8 illustrates a side of a knitted component that may be incorporated to form an interior of an article of footwear in accordance with aspects herein.

Further, in some embodiments, the cushioning structures 730 each have elongated bodies extending between a first end 717 and a second end 718 (e.g., as shown in FIG. 8). At least some cushioning structures 730 may extend longitudinally between the first end 717 and the second end 718 in a heel-to-toe direction; in the same or other embodiments, at least some cushioning structures 730 extend between the first 717 and second 718 ends laterally (i.e., in a direction parallel to the biteline 706 to throat 726 direction). In some aspects, the cushioning structures 730 vary in length and may vary in length across different regions, areas, or portions of the knitted component 720. For example, as shown in FIG. 8, a first cushioning structure 722 in the forefoot region 708 (e.g., a superior portion of the forefoot region 708) is shorter than a second cushioning structure 724 (e.g., inferior to the first cushioning structure 722). The cushioning structures' respective heights may vary as well. For example, a first cushioning structure may have a first height, a second cushioning structure may have a second height, and cushioning structures positioned between the first cushioning structure and the second cushioning structure may gradually vary in height from the first height to the second height. When the cushioning structures 730 are oriented in a heel-to-toe direction (as shown in FIG. 8), the cushioning structures 730 may increase in height from bottom to top or from top to bottom. As an example, a first cushioning structure positioned proximate to a midfoot region may have a greater height than a second cushioning structure positioned proximate to a biteline.

Further, some embodiments of the knitted component 720 includes window openings 740 extending through the main body portion 707. Example aspects of the window openings 740 are further described with respect to the window openings of the knitted component 100 of FIGS. 1-3, as well as window opening 520 of FIG. 5B. In some examples, the window openings 740 are located in at least the midfoot region 710 on the lateral side 714 and/or the medial side 716. In some aspects, window openings 740 are located in any of the regions 708, 710, and 712 on the lateral side 714 and/or medial side 716.

The window openings 740 are visible at least on a second side 705 of the knitted component 720, which may correspond to an exterior surface of the upper 704. Further, portions of the cushioning structures 730 are visible through the window openings 740 such that cushioning structures 730 on an interior of the upper 704 may be visible when the upper 704 is viewed from an exterior of the upper 704.

In some embodiments, the main body portion 707 comprises a first color and one or more of the cushioning structures 730 comprises a second color different than the first color. Accordingly, when the article of footwear 700 (or other article into which a knitted component is incorporated) is viewed from the second side 705, the cushioning structure(s) 730 may appear visually distinct from the surrounding area of the main body portion 707, providing a viewer with a visual indication of the cushioning structures' 730 presence. In addition, the first side 703 of the main body portion 707 and the cushioning structures 730 can both comprise a first color, which may provide visual uniformity in the interior of the article of footwear 700, for example. Further, in some embodiments, a perimeter of one or more window openings 740 comprise(s) a first color, and the second side 705 of the main body portion 707 comprises a second color different than the first color. This can be accomplished by varying the color of one or more of the knit courses 504, 506, and 508 (shown in FIG. 5A) relative to the surrounding knit structure, for example.

Figure 9:
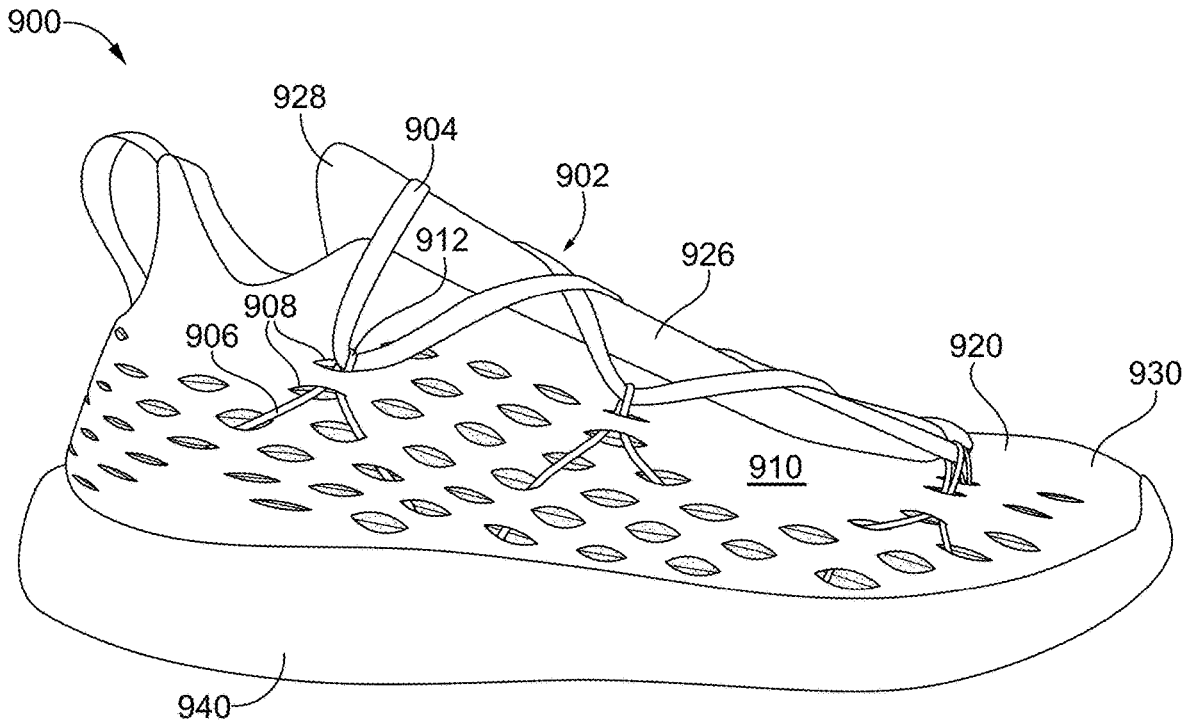
FIG. 9 illustrates an exterior view of an article of footwear in accordance with aspects herein.

Turning now to FIG. 9, an illustration of an article of footwear 900 is provided. The article of footwear 900 may comprise any of the features of the article of footwear 700, for example. The article of footwear 900 comprises a tensioning system 902 that is generally configured to keep the article of footwear 900 secured to and taut against a wearer's foot when the article of footwear 900 is worn. The tensioning system 902 comprises a lace 904 and a tensile element 906. The article of footwear 900 further comprises a knitted component 920 and window openings 908, which may correspond to any window openings previously discussed in the present disclosure and may comprise any of the properties thereof. At a high level, the tensile element 806 may serve as an anchor point for the lace 904. In some examples, the tensile element 906 is interwoven through the window openings 908, which may (at least partially) hold the tensile element 906 in place.

The tensile element 906 may comprise one or more strands of a yarn comprising any material suitable for formation of the tensioning system 802, such as nylon, polyester, or cotton. The tensile element 906 may be one of various types of cables, such as a braided cable with a greater diameter than any single strand of yarn forming the knitted component 920. The tensile element 906 may also have a higher tenacity and/or tensile strength than any strand of yarn forming the knitted component 820. Further, the tensile element 906 may comprise polyester, nylon, or other high-tenacity materials. In some examples, the tensile element 906 also includes elastane.

The tensile element 906 can be affixed to the article of footwear 900 at any suitable location, such as a portion of the upper 930 proximate to a biteline of the article of footwear 900 and/or a sole 940 of the article of footwear 900. In one example, the tensile element is affixed to an interior surface of the upper (e.g., a surface similar to the first surface 120) at an area proximate to the biteline. The tensile element 906 may be affixed using any suitable method, such as stitching, knitting, welding, or bonding. In aspects, the tensile element 906 extends upward (e.g., vertically or diagonally) from an area proximate to the biteline and/or the sole 940 into a region of the upper 930 in which the window openings 908 are present. The tensile element 906 may be interwoven through the window openings 908 such that the tensile element 906 is at least partially exposed on an exterior surface 910 of a main body portion of the upper 930 (which can correspond to the main body portion 104 of the knitted component 100). For example, the tensile element 906 may include one or more covered portions that remain interior to the knitted component 920 and one or more exposed portions that are exterior to the knitted component 920.

The tensile element 906 may further form a loop 912. The loop 912 may be positioned in or proximate to a throat region 926 of the upper 930. The loop 912 may be positioned at an uppermost or apex position of the tensile element 906, superior to at least one of the window openings 908 through which the tensile element 906 extends. The lace 904 can extend through the loop 912. Accordingly, in such embodiments, the tensile element 906 can serve as an anchor point for the lace 904, imparting the tensioning system 902 with structure and/or stability and helping to distribute any tension applied to the lace 904 throughout the article of footwear 900. In some examples, the article of footwear 900 includes a tongue 928 in the throat region 926. The tensioning system 902 may help keep the tongue 928 and the rest of the upper 930 secured to a wearer's foot. It should also be understood that the tensioning system 902 may be advantageous in creating a desired amount of tension or fit around a wearer's foot, even if the upper does not include the tongue 928.

Further, as shown in FIG. 9, the article of footwear 900 can comprise a plurality of tensile elements that respectively comprise any of the properties of the tensile element 906. The lace 904 can extend through a plurality of loops formed by respective tensile elements. For example, the lace 904 can extend through a first loop formed by a first tensile element on a first (e.g., lateral) side of the article of footwear 900, extend across the article of footwear 900 (e.g., through the throat region 926), extend through a second loop formed by a second tensile element on a second (e.g., medial) side of the article of footwear 900, extend back across the article of footwear 900 (e.g., through the throat region 926), extend through a third loop formed by a third tensile element on the first side of the article of footwear 900, and so on. In other embodiments, there is a first tensile element on a first (e.g., lateral) side forming multiple lace loops, and a second tensile element on the second (e.g., medial) side forming multiple lace loops. In another embodiment, there may be a single continuous tensile element forming a plurality of lace loops on both the medial and lateral sides of the upper 930.

Figure 10:
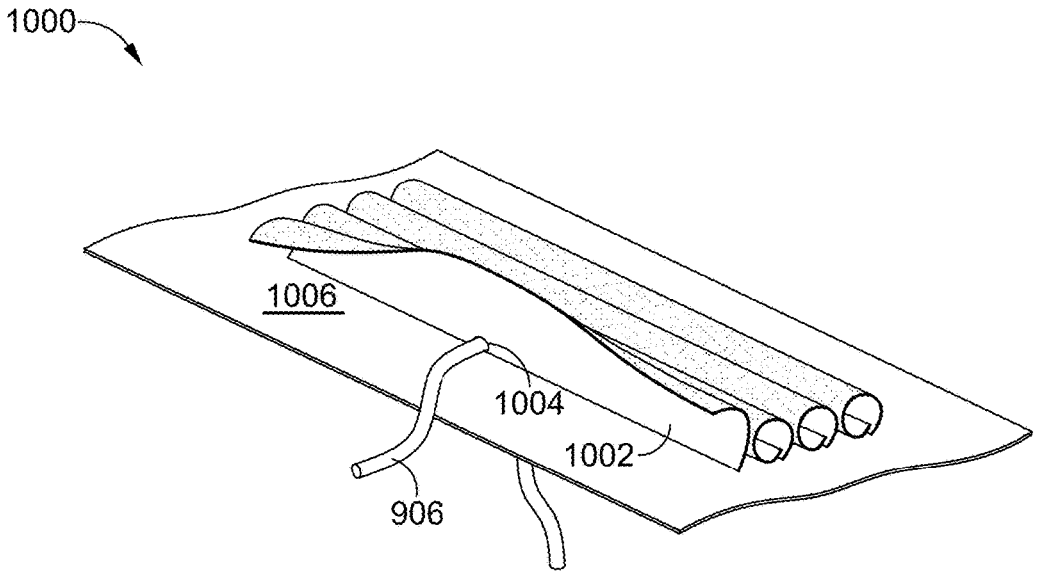
FIG. 10 illustrates a side of a knitted component that may be incorporated to form an interior of an article of footwear in accordance with aspects herein.

Turning now to FIG. 10, an illustration of an interior 1000 of the article of footwear 900 is provided. More specifically, FIG. 10 shows an exemplary manner in which the tensile element 906 can extend from an interior surface 1006 of the article of footwear 900 to an exterior of the article of footwear 900.

When the article of footwear 900 includes one or more cushioning structures 1002 (which can correspond to any of the cushioning structures described herein), the tensile element 906 may extend through a hole 1004 in the cushioning structure 1002. The hole 1004 may be positioned adjacent to (e.g., proximate to) and/or can abut the interior surface 1006 of the main body portion of the knitted component 920. In the same or other embodiments, the hole 1004 can be formed in the main body portion of the upper 930 (e.g., through the upper 930) or at an intersection between the cushioning structure 1002 and the main body portion of the upper 930 (e.g., the hole 1004 can be formed in both the cushioning structure 1002 and the main body portion of the upper). The hole 1004 can be formed using any suitable process, such as punching, or can be integrally knit with the cushioning structure and/or upper. Although only one hole 1004 is shown in FIG. 10, it should be understood that there may be a plurality of holes, each hole being present where the tensile element 906 would cross a cushioning structure on the interior side of the upper.

The tensile element 906 can, for example, extend from a point at which the tensile element 906 is attached to the upper and/or sole (as discussed in reference to FIG. 9) through the hole 1004 and to an exterior of the article of footwear 900. The hole 1004 allows the tensile element 906 to be at least partially positioned on the interior side of the knitted component 920 while extending between the main body portion and the cushioning structure 1002, rather than extending on top of the cushioning structures 1002, which would reduce the effectiveness of the cushioning structures 1002 and cause the tensile element 906 to contact a wearer's foot. In this way, because of the hole's 1004 positioning and/or the natural curling tendency of the cushioning structure(s) 1002, one or more of the cushioning structures 1002 may form a barrier between the wearer's foot and at least part of the tensile element 906, protecting the foot from abrasion.

While this disclosures utilizes the articles of footwear 700 and 900 as example articles for incorporating the knitted component 100, it should be understood that aspects of this disclosure may apply to other articles, such as articles of apparel. As such, embodiments may include an article of apparel, such as shirts, jerseys, pants, shorts, gloves, glasses, socks, hats, caps, jackets, and undergarments.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. An article of footwear comprising a knitted upper, the knitted upper comprising: a main body portion having an interior surface and an exterior surface opposite the interior surface; a first cushioning structure integrally knit with the interior surface of the main body portion; and a window opening in the main body portion, the window opening extending through the exterior surface and the interior surface, wherein at least a portion of the first cushioning structure is visible through the window opening when the knitted upper is viewed from an exterior of the knitted upper.

Clause 2. The article of footwear of clause 1, wherein the first cushioning structure comprises a chenille yarn.

Clause 3. The article of footwear of any of clauses 1-2, wherein the first cushioning structure further comprises a yarn comprising recycled leather.

Clause 4. The article of footwear of any of clauses 1-3, wherein a first edge of the first cushioning structure is integrally knit with the main body portion, and wherein a second edge of the first cushioning structure opposite the first edge is not integrally knit with the main body portion.

Clause 5. The article of footwear of clause 4, wherein the first cushioning structure comprises a single-jersey construction, and wherein the first cushioning structure comprises a curling characteristic such that the second edge contacts at least part of the interior surface of the main body portion.

Clause 6. The article of footwear of any of clauses 4-5, wherein the second edge is unsecured to the main body portion.

Clause 7. The article of footwear of any of clauses 1-6, wherein the first cushioning structure forms a tubular shape.

Clause 8. The article of footwear of any of clauses 1-7, wherein the first cushioning structure is positioned in a midfoot region of the upper on at least one of a medial side of the upper and a lateral side of the upper.

Clause 9. The article of footwear of any of clauses 1-8, wherein the window opening comprises an edge comprising a fusible material.

Clause 10. The article of footwear of any of clauses 1-9, wherein the knitted upper further comprises a second cushioning structure integrally knit with the interior surface of the main body portion.

Clause 11. The article of footwear of any of clauses 1-10, wherein the knitted upper further comprises a second window opening in the main body portion, the second window opening extending through the exterior surface and the interior surface, wherein at least a second portion of the first cushioning structure is visible through the second window opening when the knitted upper is viewed from the exterior of the knitted upper.

Clause 12. The article of footwear of any of clauses 1-11, wherein each of the first cushioning structure and the second cushioning structure extends longitudinally in a heel-to-toe direction.

Clause 13. The article of footwear of any of clauses 1-12, wherein the second cushioning structure is positioned adjacent to and contacts the first cushioning structure.

Clause 14. The article of footwear of any of clauses 1-13, wherein the article of footwear further comprises: a second window opening in the main body portion of the knitted upper, the second window opening extending through the exterior surface and the interior surface; a tensile element interwoven through the window opening and the second window opening such that the tensile element is at least partially exposed on the exterior surface of the main body portion, wherein the tensile element forms a loop superior to the window opening and the second window opening; and a lace coupled to the article of footwear and extending through the loop.

Clause 15. A knitted component comprising: a first surface; and a first cushioning structure formed of a single-jersey construction, the first cushioning structure comprising: a first edge that is integrally knit with the first surface, and a second edge opposite the first edge, wherein the second edge is not integrally knit with the knitted component, and wherein the second edge contacts the first surface such that the first cushioning structure forms a tubular shape.

Clause 16. The knitted component of clause 15, wherein the knitted component forms at least a portion of an upper of an article of footwear.

Clause 17. The knitted component of any of clauses 15-16, wherein the first surface at least partially forms an interior surface of a main body portion of the upper.

Clause 18. A method of forming an upper for an article of footwear, the method comprising: knitting a main body portion of the upper from a first yarn, the main body portion comprising an exterior surface and an interior surface opposite the exterior surface; knitting a first cushioning structure integrally with the interior surface of the main body portion, wherein the first cushioning structure is formed of a single-jersey construction; and knitting a window region within the main body portion, wherein the window region is positioned to overlap a portion of the first cushioning structure that is unsecured to the main body portion when the main body portion is removed from a knitting machine.

Clause 19. The method of clause 18, wherein knitting the window region comprises knitting a second yarn such that one or more courses of the second yarn connect a first course of the first yarn to a second course of the first yarn of the second yarn connects a first course of the first yarn to a second course of the first yarn, wherein the second yarn is a fusible yarn.

Clause 20. The method of any of clauses 18-19, wherein the method further comprises plating the first course of the first yarn with the second yarn, and wherein the first yarn is absent from the one or more courses of the second yarn.

Clause 21. The method of any of clauses 18-20, wherein the method further comprises exposing the second yarn to a stimulus in at least the window region such that a window opening is formed between the first course of the first yarn and the second course of the first yarn.

Clause 22. The method of any of clauses 18-21, wherein the main body portion is knitted using needles on a first needle bed and needles on a second needle bed, and wherein the knitting the first cushioning structure comprises: transferring loops of the first yarn from the first needle bed to the second needle bed; forming loops of a third yarn on the first needle bed; and integrally joining the loops of the third yarn with the loops of the first yarn.

Clause 23. The method of clause 22, wherein the third yarn is a chenille yarn.

Clause 24. The method of any of clauses 18-23, wherein the method further comprises knitting a second cushioning structure integrally with the interior surface of the main body portion, wherein the second cushioning structure is formed of a single-jersey construction, and wherein each of the first cushioning structure and the second cushioning structure is knitted to extend longitudinally in a heel-to-toe direction when the upper is incorporated into the article of footwear.

Clause 25. The article of footwear of any of clauses 1-14, the main body portion having a first color and the first cushioning structure having a second color different than the first color.

Clause 26. The article of footwear of any of clauses 1-14 and 25, the interior surface of the main body portion having a first color and the cushioning structure having the first color.

Clause 27. The article of footwear of any of clauses 1-14 and 25-26, wherein a perimeter of the window opening comprises a first color and the exterior surface of the main body portion comprises a second color different than the first color.

Clause 28. The knitted component of any of clauses 16-17, wherein the first cushioning structure is positioned in at least one of a medial portion of the upper, a lateral portion of the upper, and a heel portion of the upper.

Clause 29. An article of apparel comprising the knitted component of clause 15.

Clause 30. The knitted component of any of clauses 15-17 and 28-29, further comprising: a second surface opposite the first surface; and a window opening in the knitted component extending through the first surface and the second surface, wherein at least a portion of the first cushioning structure is visible through the window opening when the knitted component is viewed from a side corresponding to the second surface of the knitted component.

Clause 31. An article of apparel comprising the knitted component of clause 30.

Clause 32. A knitted component comprising: a first surface; a second surface opposite the first surface; a plurality of window openings each extending through the first surface and the second surface; and a cushioning structure positioned on the first surface and integrally knit with the first surface, wherein the cushioning structure is visible through at least one of the plurality of window openings when viewed from a side of the knitted component corresponding to the second surface.

Clause 33. An article of footwear comprising an upper at least partially formed from the knitted component of clause 32.

Clause 34. The article of footwear of clause 33, wherein the cushioning structure extends from a heel region of the article of footwear to a toe region of the article of footwear.

Clause 35. The article of footwear of clause 33, wherein the cushioning structure is positioned in a toe region of the article of footwear and does not extend into a heel region of the article of footwear.

Clause 36. The article of footwear of clause 33, wherein the cushioning structure is positioned in a heel region of the article of footwear and does not extend into a toe region of the article of footwear.

Clause 37. The knitted component of any of clauses 32-36, wherein the cushioning structure forms a tubular shape.

Clause 38. The knitted component of any of clauses 32-37, wherein the cushioning structure is curved.

Clause 39. The knitted component of any of clauses 32-38, wherein the cushioning structure is curled such that it forms a convex shape when viewed from a side corresponding to the first surface.

Clause 40. An article of apparel comprising the knitted component of any of clauses 32-39.

What is claimed is:

1. An article of footwear comprising a knitted upper, the knitted upper comprising:

a main body portion having an interior surface and an exterior surface opposite the interior surface;

a first cushioning structure integrally knit with the interior surface of the main body portion; and a window opening in the main body portion, the window opening extending through the exterior surface and the interior surface, wherein at least a portion of the first cushioning structure is visible through the window opening when the knitted upper is viewed from an exterior of the knitted upper, wherein a first edge of the first cushioning structure is integrally knit with the main body portion, and wherein a second edge of the first cushioning structure opposite the first edge is not integrally knit with the main body portion, and wherein the first cushioning structure comprises a single-jersey construction, and wherein the first cushioning structure comprises a curling characteristic such that the second edge contacts at least part of the interior surface of the main body portion.

2. The article of footwear of claim 1, wherein the second edge is unsecured to the main body portion.

3. The article of footwear of claim 1, wherein the first cushioning structure forms a tubular shape.

4. The article of footwear of claim 1, wherein the first cushioning structure is positioned in a midfoot region of the upper on at least one of a medial side of the upper and a lateral side of the upper.

5. The article of footwear of claim 1, wherein the window opening comprises an edge comprising a fusible material.

6. The article of footwear of claim 1, wherein the article of footwear further comprises:

a second window opening in the main body portion of the knitted upper, the second window opening extending through the exterior surface and the interior surface;

a tensile element interwoven through the window opening and the second window opening such that the tensile element is at least partially exposed on the exterior surface of the main body portion, wherein the tensile element forms a loop superior to the window opening and the second window opening; and a lace coupled to the article of footwear and extending through the loop.

7. A knitted component comprising:

a first surface;

a second surface opposite the first surface;

a plurality of window openings each extending through the first surface and the second surface; and a cushioning structure positioned on the first surface and integrally knit with the first surface, wherein the cushioning structure is visible through at least one of the plurality of window openings when viewed from a side of the knitted component corresponding to the second surface of the knitted component, wherein the cushioning structure is formed of a single-jersey construction and further comprises a first edge that is integrally knit with the first surface and a second edge opposite the first edge, and wherein the second edge is not integrally knit with the knitted component, and wherein the second edge contacts the first surface such that the first cushioning structure forms a tubular shape.

8. An article of footwear comprising an upper at least partially formed from the knitted component of claim 7.

9. An article of apparel comprising the knitted component of claim 7.

10. The knitted component of claim 7, wherein the cushioning structure comprises a first edge and a second edge, wherein the second edge contacts the first surface such that the cushioning structure forms a tubular shape.

11. An article of footwear comprising a knitted upper, the knitted upper comprising: a first surface; a second surface opposite the first surface;

a plurality of window openings each extending through the first surface and the second surface; and a cushioning structure positioned on the first surface and integrally knit with the first surface, wherein the cushioning structure is visible through at least one of the plurality of window openings when viewed from a side of the knitted component corresponding to the second surface of the knitted component, wherein the cushioning structures comprises at least one edge that is not integrally knit with the knitted component, and wherein the at least one edge contacts the first surface.

12. The article of footwear of claim 11, wherein the cushioning structure is formed of a single-jersey construction and further comprises a first edge that is integrally knit with the first surface and a second edge opposite the first edge.

13. The article of footwear of claim 12, wherein the second edge is not integrally knit with the knitted component, and wherein the second edge contacts the first surface such that the first cushioning structure forms a tubular shape.

14. The article of footwear of claim 11, wherein at least one of the window openings comprises a second yarn, wherein one or more courses of the second yarn connect a first course of a first yarn to a second course of the first yarn, and wherein the second yarn is a fusible yarn.

15. The article of footwear of claim 14, wherein the first course of the first yarn is plated with the second yarn, and wherein the first yarn is absent from the one or more courses of the second yarn.

* * * * *